United States Patent [19]

Nagano

[11] Patent Number: 5,045,981

[45] Date of Patent: Sep. 3, 1991

[54] LIGHTING SYSTEM WITH EASILY REPLACEABLE BULBS AND RETROFITTING COVER

[75] Inventor: Thomas T. Nagano, Cerritos, Calif.

[73] Assignee: Tivoli Industries, Inc., Santa Ana, Calif.

[21] Appl. No.: 477,615

[22] Filed: Feb. 9, 1990

[51] Int. Cl.[5] ..... F21S 1/14

[52] U.S. Cl. ..... 362/219; 362/226; 362/249; 362/147; 439/436; 439/117

[58] Field of Search ..... 362/217, 219, 226, 249, 362/221, 223, 225, 238, 240, 145, 146, 152, 153, 147; 439/117, 237, 436, 437, 438, 439

[56] References Cited

U.S. PATENT DOCUMENTS

| | | | |
|---|---|---|---|
| 2,192,899 | 3/1940 | Edmonson | 439/117 |
| 3,527,933 | 9/1970 | Thummel . | |
| 4,173,382 | 11/1979 | Booty | 439/117 |
| 4,178,627 | 12/1979 | Baumann | 362/238 |
| 4,204,273 | 5/1980 | Goldberg | 362/217 |
| 4,397,514 | 8/1983 | Durand et al. | 439/436 |
| 4,410,228 | 10/1983 | Stephenson | 439/436 |
| 4,482,944 | 11/1984 | Rossine et al. | 362/418 |
| 4,514,791 | 4/1985 | Tokieda | 362/249 |
| 4,628,421 | 12/1986 | Saar | 362/238 |
| 4,631,650 | 12/1986 | Ahroni | 362/249 |
| 4,654,765 | 3/1987 | Laidman | 362/238 |
| 4,777,573 | 10/1988 | Liao | 362/249 |
| 4,807,098 | 2/1989 | Ahroni | 362/249 |

OTHER PUBLICATIONS

Brochure, Emergency Path Lighting System (Pages 5 and 6), Bruce Industries, Inc., (Oct. 23, 1985).

Brochure, Decolite-Advanced Low Voltage Lighting Products (3 Pages), Design Lighting Associates, Inc.

Brochure, Sylvan Light Channel-Low Voltage Sub-Miniature Linear Lighting (2 Pages), Sylvan Designs.

Brochure, Slim (4 Pages), Aneta Belysning AB.

*Primary Examiner*—Carl D. Price

*Assistant Examiner*—Sue Hagarman

*Attorney, Agent, or Firm*—Knobbe, Martens, Olson & Bear

[57] ABSTRACT

A low-voltage light fixture to facilitate the insertion and removal of light bulbs, where the light bulb is inserted in a socket which is releasable secured to a carriage. The electrical contact to a pair of leads on the light bulb is made by a pair of acruate terminals fastened within the carriage. The terminals have one free end so that they may bend freely upon insertion of the socket within the carriage. The socket includes a depression configured to conform to the shape of the arcuate terminals, so that the terminals snap into the depression when the socket is inserted into the carriage. The leads extend acros the depression to improve the electrical contact. The socket is further secured to the carriage by a pair of grooves which mate to the carriage's guiding rails. The invention further comprises a retrofitting cover and spring-clip mechanism for holding such cover to the housing of the string-lighting system. The spring clip has a pair of protruding brackets and a plurality of barbs which frictionally anchor the spring clip and the retrofitting cover within the channel of the housing.

24 Claims, 6 Drawing Sheets

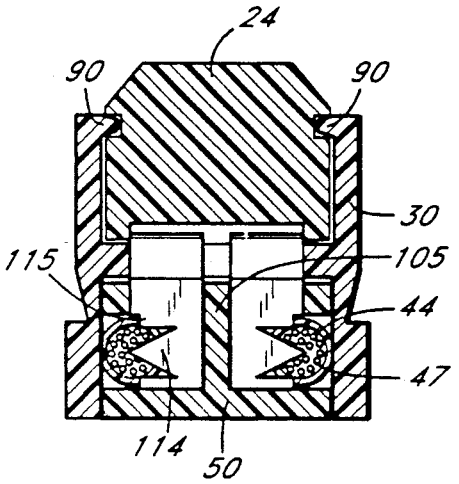
FIG. 3A
FIG. 3B
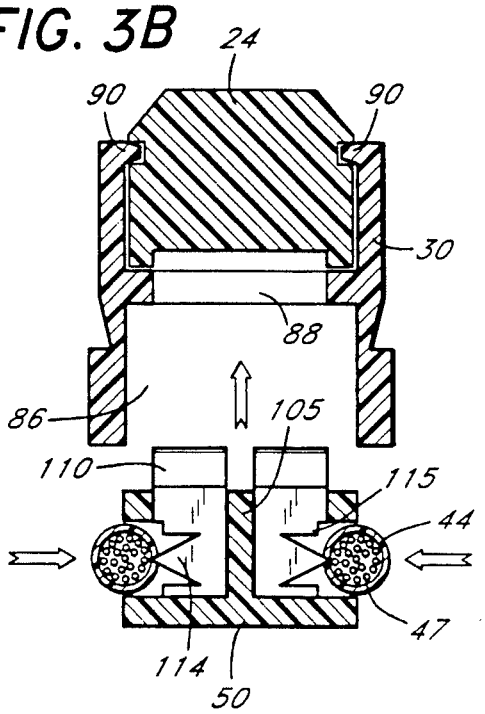
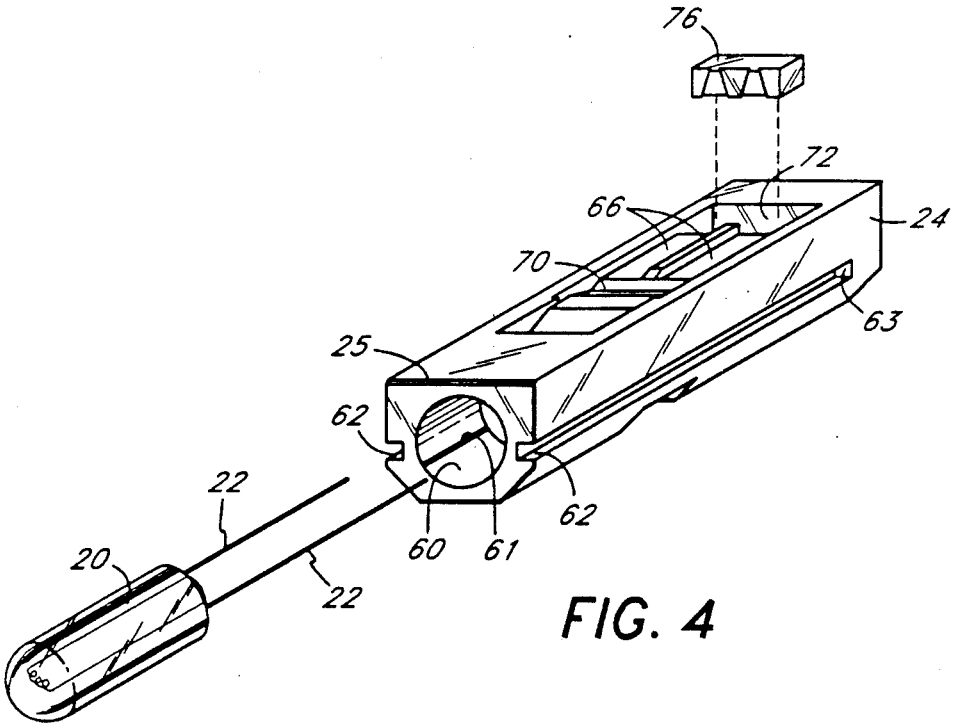
FIG. 4

LIGHTING SYSTEM WITH EASILY REPLACEABLE BULBS AND RETROFITTING COVER

FIELD OF THE INVENTION

The present invention relates to lighting fixtures having easily replaceable light bulbs. The invention further relates to retrofitting covers for those decorative lighting systems.

BACKGROUND OF THE INVENTION

Low-voltage string-lighting systems have been used extensively for decorating both private homes and commercial establishments. String-lighting systems are ideal for decoration because they can be displayed in various places and in nearly every imaginable form. For example, low-voltage string-lighting systems are often used to decorate walls, floors, ceilings, and staircases, of restaurants, nightclubs, hotels, and movie theaters. One of the more common commercial uses of string-lighting systems is aisle lighting in movie theatres, where a string of lights is placed down each side of an aisle.

A typical low-voltage string-lighting system, such as those used for aisle lighting, includes a power line having multiple light fixtures attached thereto (hereinafter a "light string"), an external housing made of a durable material such as vinyl or aluminum, and an external covering which is translucent and generally fits within the housing. The external housing is typically manufactured by an extrusion process and is commonly referred to in the lighting industry as an extrusion. Accordingly, that external housing shall be referred to as a housing extrusion.

A single light string in a common string-lighting system may include dozens of individual light bulbs. Because string-lighting systems include so many light bulbs, it is common for some of the bulbs to burn out. Thus, it is frequently necessary to replace one or more light bulbs on a light string. It may also be desirable to change light bulbs for decorative reasons, for example, to change the bulbs to a different color. It is therefore desirable to have a decorative string-lighting system which has easily replaceable light bulbs.

Conventional string-lighting systems have fallen short of this goal. In order to replace a single light bulb in some conventional string-lighting systems, it is necessary to twist or solder the light bulb leads onto a spliced section of the power line. Thus, the process of connecting individual light bulbs is very time consuming and inconvenient. Because of the complexity of the connection described above, it is possible that a poor connection may be made that could result in an electrical short circuit.

One prior art lighting system which attempted to facilitate bulb replacement is shown in U.S. Pat. No. 4,514,791. In this system, the bulb has a pair of leads bent over a circular casing which is then inserted into a socket. The electrical contact between the conducting wires and socket terminals requires soldering to affix the socket to the wires.

A system of this kind includes many drawbacks. In particular, because it may be necessary to replace a light bulb several times for a specific socket, the terminals within the socket are likely to become deformed so that a loose connection occurs between the light-bulb leads and the terminals. A system of this sort also includes the additional disadvantage requiring a custom set of conducting wires which are exposed at predetermined locations. Finally, the connection between the socket and the wire is poor because it is often desireable to bend or shape a light string. Thus, it is possible that the solder connections will be placed under considerable stress so that the durability of the soldered connections is compromised.

In another string-lighting system, the leads of each light bulb are inserted directly into holes provided within each socket. See for example U.S. Pat. No. 4,482,944. The conducting terminals within each socket are formed so that they act like spring clips. The leads are then inserted into the socket so that the conducting terminals exert pressure on either side of the inserted leads and hold the leads fast. Each conducting terminal is spot welded onto a conducting belt.

This system has the disadvantages of deforming the contact terminals and stressing the connections between the conducting terminals and the conducting belts. Furthermore, because the leads of ordinary low-voltage light bulbs are quite thin, a number of these leads will be bent or broken while inserting the bulbs into the socket.

In addition to the problems of replacing individual light bulbs in conventional string-lighting systems, further problems exist when replacing an entire string-lighting system. It is often desirable to replace a string-lighting system when the old assembly has deteriorated. In addition, it is sometimes desirable to replace a string-lighting system which does not have the latest features. However, replacing a conventional string-lighting system is very time consuming and costly. The housing extrusions of a typical string-lighting system usually are mounted to a surface (e.g., a floor) by an adhesive or rivets. Often it is necessary to tear out carpet, wallpaper, or other decorative items which surround the mounted housing extrusions when replacing a string-lighting system.

Because conventional replacement procedures for a string-lighting system are time consuming, an economic burden may be placed on a facility which is required to close down for the duration of the replacement process. In many cases, only the light string or the external covering of the string-lighting system is in a deteriorated condition, while the more durable mounted housing extrusion is still suitable for use. Thus, in many instances it is desirable to replace only the light string or the exterior covering of the string-lighting system. For these reasons, it would be preferable if the string-lighting system that was already installed could be altered to look like new in a short period without having to tear out the mounted housing extrusions that are already in place.

In conventional string-lighting systems, the housing extrusion is provided with a rectangular groove which houses the light string. Typically, a removable external covering is then situated within the rectangular groove so that the light string is encapsulated by both the external covering and the housing extrusion. Some manufacturers produce housing extrusions which have different dimensions than housing extrusions produced by other manufacturers. For this reason, it is difficult to provide an external covering which is retrofitting and which can be fitted to housing extrusions of different manufacturers. Thus, if the owner of a string-lighting system wants to replace his system without replacing the housing extrusions, the owner would be forced to return to the same manufacturer for an external covering even if he were not completely satisfied with that manufacturer's external covering. This problem is further aggravated if the manufacturer of a particular string-lighting system has gone out of business, or has stopped producing a particular model, so that the owner is forced to tear out the mounted housing extrusions in order to obtain a new string-lighting system. A need exists for a string-lighting system which is easily replaceable and which provides a retrofitting external covering that can be used to refurbish the string-lighting systems of different manufacturers.

An object of the present invention is to provide a string-lighting system which has bulbs that can be replaced quickly and easily. Another object of the present invention is to provide a string-lighting system which is durable despite repeated replacement of light bulbs. Another object is to provide a light fixture which is securely fastened to the conducting wires without the need for soldering or the like. Moreover, the socket is releasable but tightly secured within the fixture.

A further object of the present invention is to provide a retrofitting cover for preexisting housings of different manufacturers. The cover would allow the refurbishing of the old systems with the present invention without the costly removals of housings, which are affixed to the lighted structure. The retrofitting cover is aesthetically pleasing, therefore allowing the system to appear new and attractive.

SUMMARY OF THE INVENTION

The present invention is a low-voltage light fixture for use with a lighting system, the fixture is configured to facilitate insertion and removal of the light bulb and to provide a secure connection of the light bulb within the fixture. The fixture comprises the light bulb, which has a pair of conducting leads, a socket to hold the light bulb in position so that a portion of the conductive lead is exposed, the socket also including a plurality of channels on its exterior. The light fixture also has a carriage having two walls separated by a perpendicular cross piece, the cross piece forming an upper slot and a lower slot in the carriage and having an aperture for the exposed leads. The walls have a plurality of guiding rails in the upper slot to engage with the channels of the socket. The fixture includes conducting wires, a base within the lower slot of the carriage, the base having lateral slots for the insertion of the conducting wires. Lastly, the light fixture has conducting terminals, each of the conducting terminals having a contacting portion which is in electrical contact with the conducting wires and an arcuate portion which is in electrical contact with each of the exposed leads of the light bulb.

In a preferred embodiment, the socket may have a plurality of receptacles which retain the leads of the light bulb. In that embodiment, the socket also has a lead retainer plug which rests in the receptacles to secure the leads within the receptacle. Moreover, it is preferred if the socket has a depression so that the leads of the light bulb extend over the depression and the arcuate portion of the conducting terminals is proximate to that depression. In this embodiment, the arcuate portion of the terminals exerts a force against the leads so that tension is produced in the leads to improve the electrical contact and hold the socket on the carriage.

In another preferred embodiment, the base includes a gap and has a plug which fits into the gap to hold the conducting terminals into the base. Moreover, the base may preferably have a groove to allow the ends of the terminals to rest freely.

In another preferred embodiment, the present invention includes conducting terminals which have contacting portions which are pointed so that they penetrate into the conducting wires.

The present invention also includes an improved decorative lighting system which has a plurality of the light fixtures attached to the conducting wires. The decorative lighting system includes an external housing having a channel which contains the light fixtures. It includes a spring clip which is compressibly secured within the channel, the spring clip including a plurality of protruding brackets, and barbs which frictionally anchor the spring clip into the channel. Lastly, the decorative lighting system includes a translucent external covering which has a receiving bracket to engage the protruding bracket so that the covering can be affixed to the spring clips so that the external covering covers the channel.

In a preferred embodiment, the translucent external covering covers the external housing. Preferably, the spring clip is made of metal and the protruding brackets extend above the channel to engage the external covering.

BRIEF DESCRIPTION OF THE DRAWINGS

FIG. 3A is a cross-sectional view of the light fixture along the line 3A—3A of FIG. 1.

FIG. 3B is an exploded cross-sectional view of the light fixture along the line 3A—3A of FIG. 1.

FIG. 4 is an exploded perspective view of the underside of the light bulb socket.

DETAILED DESCRIPTION OF THE PREFERRED EMBODIMENT LIGHT FIXTURE ASSEMBLY

Figure 1:
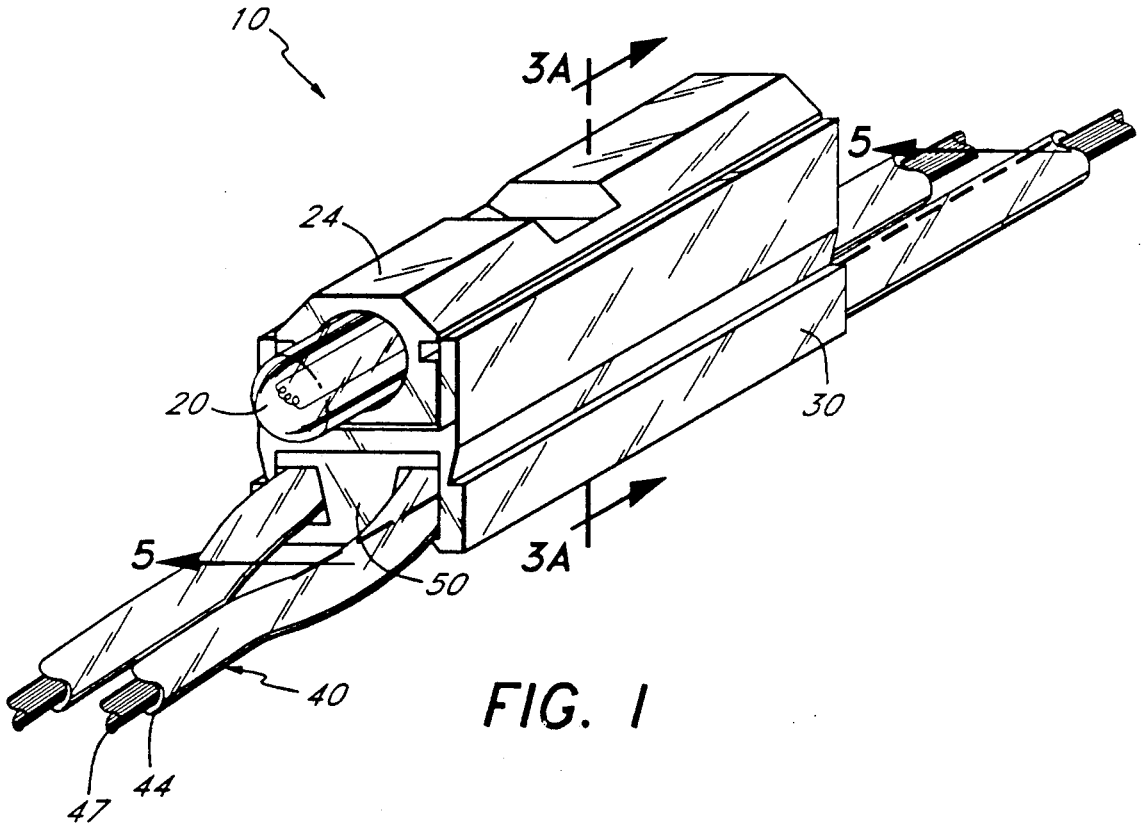
FIG. 1 is a perspective view of a light fixture of the present invention.

FIG. 1 illustrates a perspective view of a light fixture 10 made in accordance with the present invention. The fixture 10 is approximately one to two inches in length. A conventional low-voltage light bulb 20 is secured within a socket 24. The socket 24 is removable and conveniently slides into place within a carriage 30. Conducting wires 40 have an insulating coating 44. Conducting wires 40 provide a source of low-voltage power, and run longitudinally through a base 50 of the carriage 30. The wires 40 pass through separate portions of the base 50, as shown in FIG. 1. They are fastened securely so that the carriage 30 does not slide. Each component will be discussed in more detail below.

Figure 2:
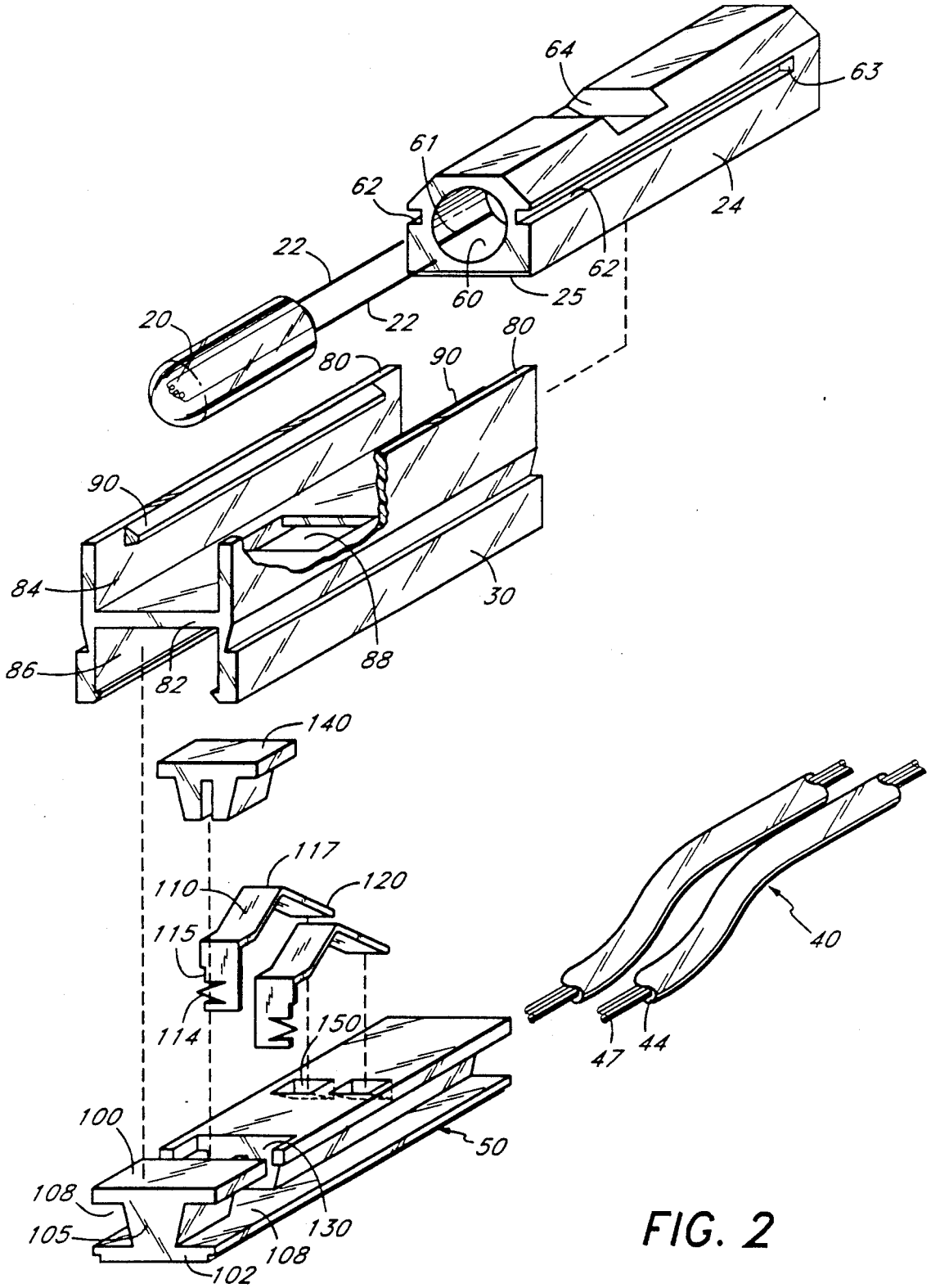
FIG. 2 is an exploded perspective view showing components of the light fixture of the present invention.

FIG. 2 shows an exploded view of the light fixture 10 illustrated in FIG. 1. As can be seen in FIG. 2, the light fixture 10 comprises four main components in addition to the light bulb 20 and wires 40: the socket 24, the carriage 30, the base 50 and the terminals 110.

THE SOCKET

The socket 24 can have various configurations as long as it holds the light bulb 20 and can be easily removed from the carriage 30. For example, the socket 24 can be round or rectangular. The socket 24 can be made of a number of materials. For example, the socket 24 may be made of plastic, acrylic, or some other moldable resin. The socket 24 has a shaft 60 where the light bulb 20 is inserted. Preferably, the shaft has a plurality of linear protrusions 61 which would accommodate bulbs of slightly different sizes. Larger bulbs 20 would compress or bend the protrusions 61 to maintain a tight grip without breaking the bulb 20 upon insertion. The light bulb 20 might also, for example, be glued within the shaft 60 of the light bulb socket 24 to insure that the bulb 20, and a pair of leads 22, fit securely within the socket 24. In this way, one can easily handle the light bulb 20 when it is protected by the socket 24.

The socket 24 also includes a pair of channels 62 which are parallel to one another and are formed on opposite sides of the socket 24. The channels 62 are open on the front end of the socket 24 where the light bulb 20 is inserted into the shaft 60, and are closed on the rear end at 63. Though channels are preferred, any configuration which allows a releasable snap-connection with the carriage 30 is sufficient.

The socket 24 also includes a notch 64 on the topside of the socket 24 which provides a gripping point for a user's finger so that the socket 24 can be easily slid into, and out of, the carriage 30 without the use of tools.

FIG. 4 depicts a perspective view of the underside of the socket 24. The underside has a triangular depression 70. It further includes a pair of paths 66 which terminate at a receptacle 72. As mentioned, the light bulb 20, with the leads 22, is inserted into the shaft 60. The two leads 22 are led smoothly along paths 66 so that they extend across the triangular depression 70. Finally, the ends of the leads 22 are inserted into the receptacle 72. The excess end portions of the leads 22 are then secured within the receptacle 72 by a retainer plug 76. Preferably the plug 76 is one piece though it retains the leads 22 in two separate portions of the receptacle 72. In an alternative embodiment, separate receptacles 72 are provided for each lead 22 so that the danger of a short circuit is eliminated.

The retainer plug 76 is advantageously glued into the receptacle 72 so that the leads 22 are held stationary within the receptacle 72. Advantageously, the light bulb 20 is also glued into the shaft 60 so that the light bulb 20 is immobile within the socket 24. Thus, the socket 24, and the light bulb 20 form a self contained bulb cartridge which can easily be removed from, and inserted into, the carriage 30 in a matter of seconds.

THE CARRIAGE

The carriage 30 comprises a pair of parallel walls 80 which are separated by a perpendicular crosspiece 82. An upper slot 84 and lower slot 86 are formed on opposite sides of the crosspiece 82 so that the carriage 30 is H-shaped. Of course, the carriage 30 need not be H-shaped. In practice, any configuration of the carriage 30 which releasably supports the socket 24 is acceptable. The middle crosspiece 82 has an opening 88 therethrough which connects the upper slot 84 and the lower slot 86. The opening 88, whose purpose will be more thoroughly discussed later, allows the terminals 110 to contact the leads 22.

The upper slot 84 includes a pair of guiding rails 90 on the interior surface of the walls 80. The guiding rails 90 run parallel to one another longitudinally down a portion of the upper slot 84. The guiding rails 90 are provided so that the socket 24 can slide easily in and out of the upper slot 84 of the carriage 30. When the socket 24 is inserted into the upper slot 84, the guiding rails 90 engage with the channels 62 so that the guiding rails 90 slide down the length of the channels 62. The guiding rails 90 are formed so that they fit snugly within the channels 62.

In order to properly position the socket 24 within the carriage 30, the socket 24 is slid front end first into either end of the upper slot 84. The channels 62, and the guiding rails 90 are constructed so that either end of the guiding rails 90 provides an obstruction for the closed end 63 of the grooves 62. Thus, as the socket 24 is slid into the upper slot 84, the guiding rails 90 hit end 63 so that the socket 24 cannot slide out of the other end of the upper slot 84. The channels 62, and the guiding rails 90 are advantageously constructed so that when the socket 24 is halted by the closed end 63 of the channels 62, both ends of the socket 24 and the carriage 30 are aligned. That is, there is no overhang of the socket 24 over the edge of the carriage 30.

BASE

The lower slot 86 provides an enclosure for the base 50. The base 50 includes an upper crossbeam 100, a lower crossbeam 102, and a center wall 105 so that the base 50 is formed in the shape of an I-beam. However, the base 50 need not be I-shaped. In practice, the base 50 can be configured to accommodate the wires 40 as long as the base 50 fits within the lower slot 86. A pair of lateral slots 108 are formed on opposite sides of the center wall 105. The base 50 is advantageously slid into the lower slot 86, and is then permanently affixed within the lower slot 86. Of course, the base 50 need not be slid into the lower slot 86. For example, the base 50 may be inserted vertically and glued within the lower slot 86. The base 50 may be formed in a configuration so that it snaps into the lower slot 86, thereby requiring no glue to fasten it within the carriage 30.

TERMINALS

Also depicted in FIG. 2 are a pair of conducting terminals 110. The terminals 110 include contacts 114, arcuate portions 117, and end portions 120. The terminals 110 are situated within a gap 130 in the upper crossbeam 100 so that the contacts 114 are positioned on either side of the center wall 105 so as to point outwardly, as shown in FIG. 2. The center wall 105 provides an insulating barrier between the terminals 110 so that the risk of electrical short circuit is minimized. The contacts 114 of the terminals 110 are advantageously secured within the base 50 by a $\pi$-shaped plug 140. The ends 120 of the terminals 110 are positioned so that they rest freely within a pair of sawtooth grooves 150 formed in the top surface of the upper crossbeam 100. As shall be discussed below with reference to FIG. 5, the sawtooth depressions 150 provide a region of flexibility so that the conducting terminals 110 are free to flex at arcuate portions 117.

One problem arising with penetrating-type terminals is that pulling the wires may cause the contacts 114 to bend and no longer secure the fixture 10 to the wires 40. The present invention includes tangs 115 adjacent to each side of contacts 114 which cause the contacts to penetrate further into wires 40. The tangs 115 preferably are angled relative to the contacts 114 to facilitate the gripping action caused by the tension on the wires 40.

ASSEMBLING THE LIGHT FIXTURE

FIG. 2 shows the conducting wires 40. The conducting wires 40 are advantageously inserted within the lateral slots 108. FIGS. 3A and 3B illustrate one way that the conducting wires 40 may be inserted within the light fixture 10.

FIG. 3A depicts a cross-section of the light fixture 10 along a line 3A—3A in FIG. 1. FIG. 3A illustrates how the base 50 is positioned within the lower slot 86 of the carriage 30. Arcuate portions 117 protrude through the opening 88 in the crosspiece 82 so that the terminals 110 are exposed in the upper slot 84. As mentioned above, the base 50 is advantageously fastened within the carriage 30 so that the wires 40 are enclosed within tunnels formed by the lateral slots 108 and the walls 80 of the carriage 30.

FIG. 3B depicts an exploded view of the cross-section shown in FIG. 3A. The terminals 110 are positioned within the lateral slots 108 on opposite sides of the center wall 105. The wires 40 are at least partially inserted within the lateral slots 108. As illustrated in FIG. 3B, the conducting wires 40 are initially inserted into the lateral slots 108 so that the contacts 114 slightly penetrate the insulating coating 44 of the conducting wires 40. As the base 50 is inserted upwards into the lower slot 86 of the carriage 30, pressure is applied to the outside edges of the wires 40. The pressure exerted by the walls 90 of the carriage 30 cause the contacts 114 to further penetrate into the conductive regions 47 of both wires 40. In this manner, a secure electrical connection can be made between the terminals 110 and the wires 40 as depicted in FIG. 3A. Of course, a variety of procedures can be used to insert the wires 40 within the light fixture 10 so that an electrical contact is made between the wires 40 and the terminals 110. For example, but less preferably, the wires 40 may be stripped along certain regions so that the contacts 114 are not needed to make an electrical contact with the terminals 110.

Figure 5:
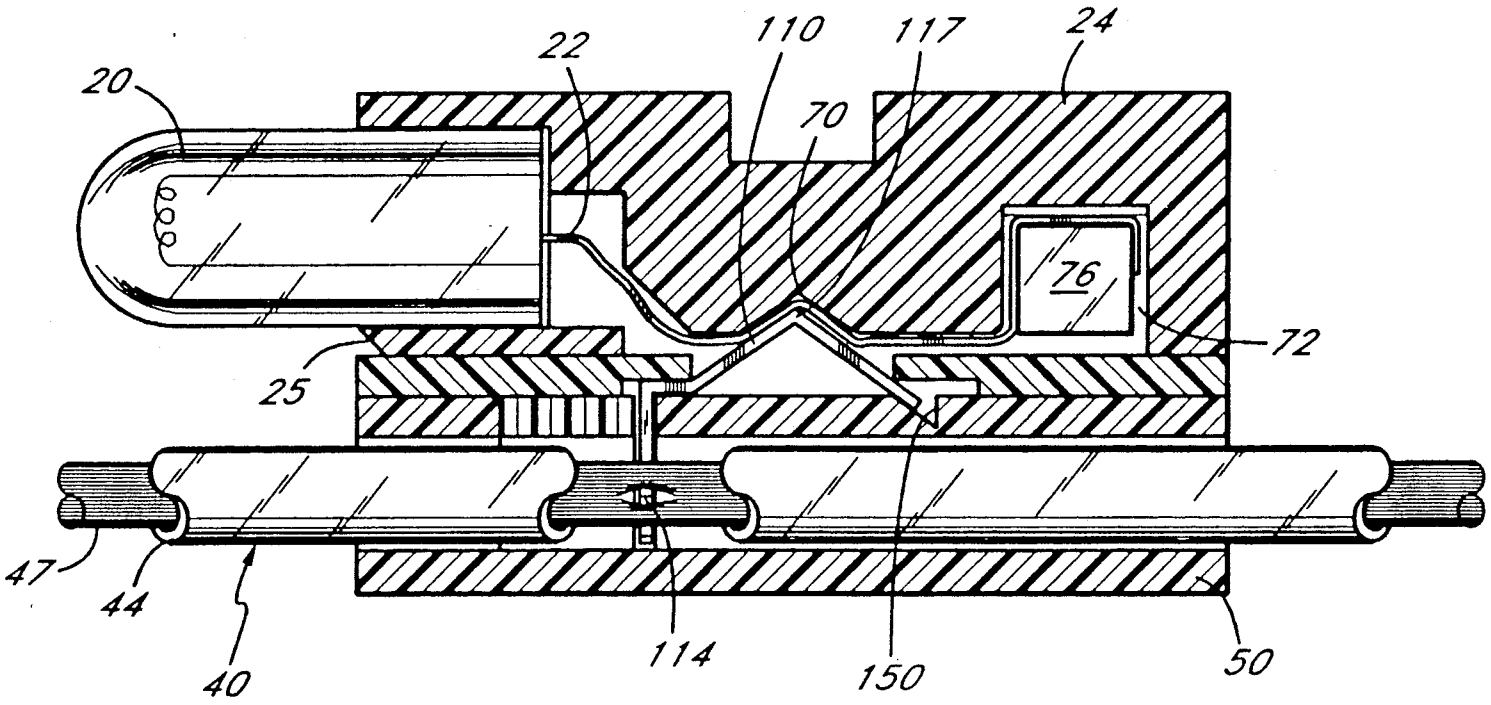
FIG. 5 is a partial cross sectional view along the line 5—5 of the assembled light fixture.

FIG. 5 depicts a longitudinal cross-section of the assembled light fixture 10 along a line 5—5 in FIG. 1. FIG. 5 illustrates how an electrical connection is made between the leads 22 and the terminals 110. As noted above, the arcuate portions 117 of the terminals 110 protrude through the opening 88 in the crosspiece 82. In FIG. 5, the terminal 110 is shown to penetrate through the opening 88 and make contact with one of the leads 22. The arcuate portion 117 of the terminal 110 is advantageously positioned proximate to the triangular depression 70 when the socket 24 is in place. When the socket 24 is in place, each lead 22 is interposed between the arcuate portion 117 of the terminal 110, and the triangular depression 70.

As the socket 24 is drawn into the upper slot 84 of the carriage 30, the front end of the socket 24, which preferably has a slope 25, comes into contact with the terminals 110. As mentioned above, the end portions 120 of the terminals 110 rest freely within the sawtooth grooves 150. Thus, the terminals 110 are allowed to bend freely so that the socket 24 may be drawn over the terminals 110 without permanently deforming the arcuate portions 117. The slope 25 initially pushes the terminals 110 downwardly so the socket 24 can continue over the terminals. When the socket 24 has been drawn into the upper slot 84 so that the triangular depression 70 is proximate to the arcuate portions 117 the terminals 110 bend back so that they conform to the surface of the triangular depression 70 as shown in FIG. 5.

In this manner, the depression 70 serves two purposes. First, when the terminals 110 bend back into the depression 70, they exert a force against the socket 24 which holds the socket 24 in place. The bending of the arcuate portions 117 into the depression 70, acts to "snap" the socket 24 into place within the carriage 30. Second, because the leads 22 are interposed between the arcuate portions 117 and the depression 70, tension is produced in the leads 22. The tension in the leads 22 provides a greater region of contact between the leads 22 and the terminals 110. This greater region of contact in turn provides improved electrical conduction between the light bulb 20 and the terminals 110. Thus, the present invention provides secure attachment of the light socket 24 within the carriage 30, as well as providing improved electrical contact between the terminals 110 and the light bulb 20.

The present invention solves an additional problem which is prevalent in prior light fixture devices. Namely, when the socket 24 is repeatedly removed from, and inserted into, the carriage 30, the terminals 110 are not permanently deformed as in prior devices. Therefore, the benefits of improved conduction and secure attachment are not significantly compromised with repeated replacement of light bulbs in the light fixture assembly 10.

Of course, it is possible to reduce deformation of the terminals 110 using other provisions. For example, the socket 24 could be configured so that it slides in vertically rather than horizontally, so that the front end of the socket 24 does not slide over the terminals 110.

STRING-LIGHTING SYSTEM

Figure 6:
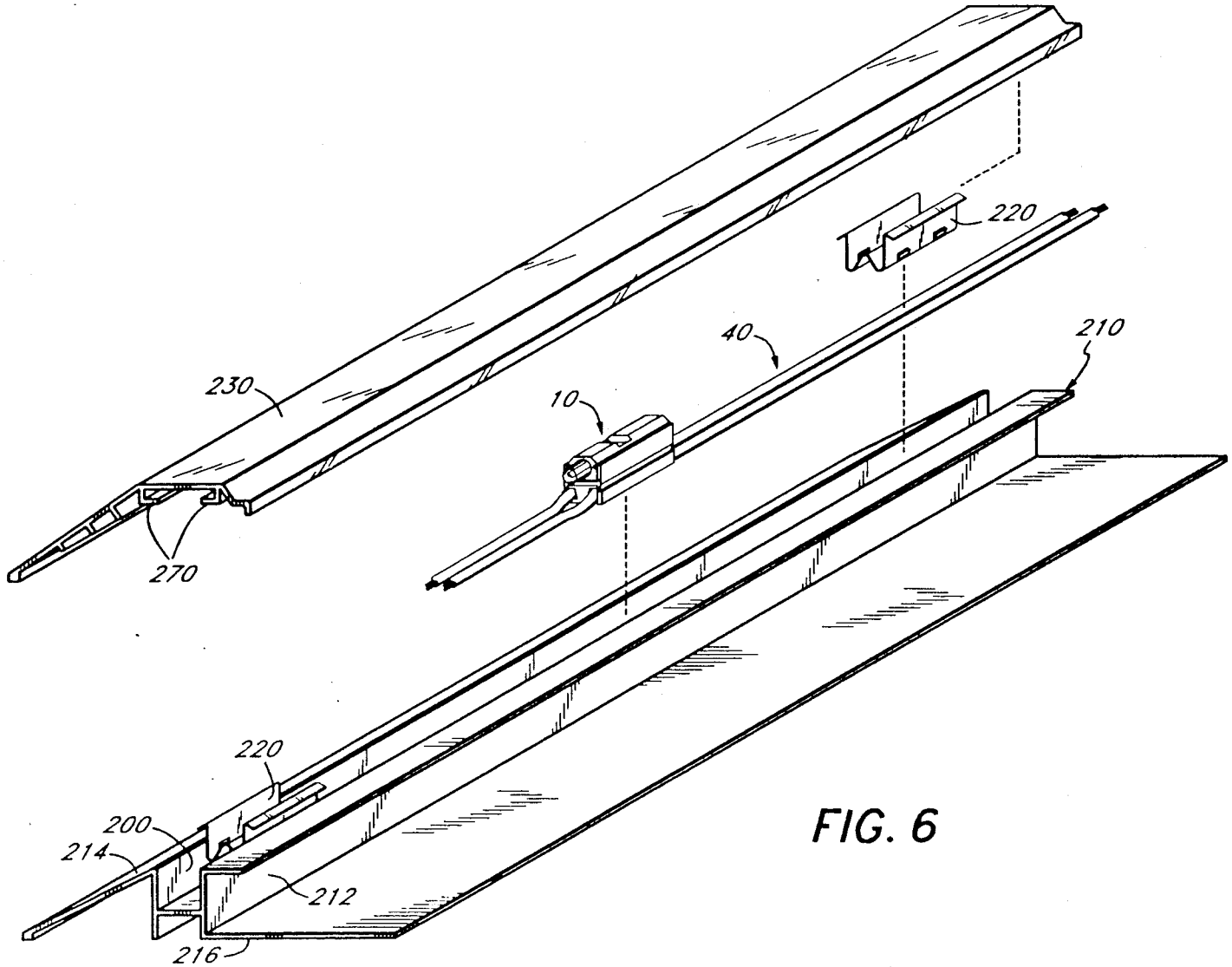
FIG. 6 is an exploded perspective view of the string-lighting system of the present invention.

FIG. 6 depicts an exploded perspective view of a preferred embodiment of the present invention. The light fixture 10 is affixed to the wires 40 and is shown to fit within a rectangular channel 200 of a conventional housing extrusion 210. Advantageously, multiple light fixtures 10 are affixed to the conducting wires 40 as described above, so that a light string is formed. The light string is then situated so that it lies within the channel 200 of the housing extrusion 210. The channel 200 is commonly 5/16 to ⅜ inch wide. The housing extrusion 210 may, for example, be made of aluminum, vinyl or any other durable material. The housing extrusion 210 includes an insert slot 212, and a shoulder 214 so that the housing extrusion 210 can be employed as a carpet-to-floor threshold. As a carpet-to-floor threshold, a portion of carpet is fit into the insert slot 212, and the shoulder 214 is fastened firmly to the floor. The housing extrusion 210 further includes a base 216 which can be mounted (e.g., bolted or glued) onto a desired surface (e.g., a floor, wall, ceiling, etc.).

Of course, the housing extrusion 210 need not be formed so that a carpet-to-floor threshold is made. For instance, the housing extrusion 210 may have insert slots on both sides to from a carpet-to-carpet partition. Alternatively, the housing extrusion 210 may be formed so that it can be mounted onto steps in a staircase. The housing extrusion 210 can also be curved to accommodate rounded surfaces.

A pair of spring clips 220 is also depicted in FIG. 6. The spring clips 220 may be constructed out of plastic, metal, or any suitable material which has elastic properties. The spring clips 220 provide a way to secure an external covering 230 onto the housing extrusion 210. The spring clips 220 are advantageously fitted into the channel 200. The spring clips 220 may fit into channels of various widths. Preferably, because most channels 200 are approximately 5/16 to ⅜ inch wide, spring clip 220 should tightly fit within such channels. Thus, housing extrusions made by different manufacturers, and having different channel widths, may still accommodate the spring clip 220.

Figure 7:
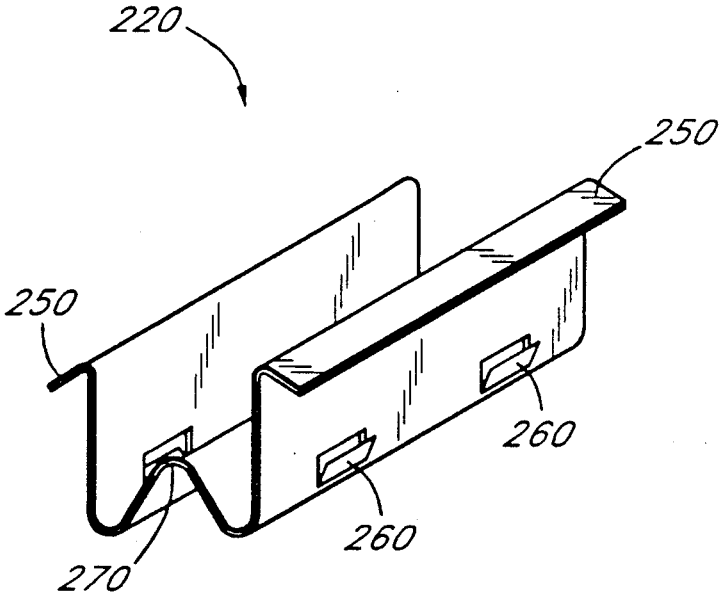
FIG. 7 is an enlarged perspective view of a spring clip used within the string-lighting system of the present invention.

FIG. 7 depicts an enlarged perspective view of the spring clip 220. The spring clip 220 includes a pair of protruding brackets 250, as well as a plurality of gripping barbs 260. When the spring clip 220 is inserted into the channel 200, the spring clip 220 bends so that flexural tension is produced between the lateral walls of the channel 200 and the sides of the spring clip 220. The barbs 260 further secure the spring clip 220 within the channel 200. Because the barbs 260 are upwardly bent, a frictional force is produced against the lateral walls of the channel 200 when the spring clip 220 is pulled out of the channel 200. The frictional force applied by the barbs 260 act to anchor the spring clip 220 within the channel 200. Preferably, the spring clip 220 has hump 270 which would allow the conducting wires 40 to pass under spring clip 220 so the wires will not interfere with the removal of the clip 220 and cover 230.

When the spring clip 220 is fastened within the channel 200, the protruding brackets 250 extend above the top surface of the housing extrusion 210. The external covering 230, having receiving brackets 270, is advantageously slid onto the surface of the housing extrusion 210. The protruding brackets 250 of the spring clip 220 engage with the receiving brackets 270 of the external covering 230. In this manner, the external covering 230 is removably fastened to the surface of the housing extrusion 210.

The external covering 230 is not limited to the shape and form depicted in FIG. 6. In practical applications, the external covering 230 may be formed to accommodate various shapes and sizes of housing extrusions such as those described above. For example, the external covering 230 may be curved or flat. Alternatively, the external covering 230 may be formed so that it does not cover the entire exposed surface of the housing extrusion 210.

The string-lighting system of the present invention allows for easy replacement of the external covering 230, even for housing extrusions made by different manufacturers. The spring clips 220 act as an interface for different sizes and shapes of housing extrusions 210 and external coverings 230. Thus, the string-lighting system described herein allows the owner of another string-lighting lighting system to refurbish his system without incurring expenses associated with replacing the mounted housing extrusions 210. Instead, the exterior of a variety of string-lighting systems can be made to look like new, while retaining the durable housing extrusions 210.

Although the present invention has been described in terms of particular embodiments, it is not limited to these embodiments. It is possible that alternative embodiments and modifications which would still be encompassed by the present invention may be made by those skilled in the art, particularly in light of the foregoing teachings. Therefore, it is submitted that the spirit and scope of the present invention should be interpreted and defined by the following claims.

We claim:

1. A low-voltage light fixture configured to facilitate the replacement of expired light bulbs and to improve the conductive contact with the light bulb in the light fixture despite the repeated replacement of expired bulbs, said fixture comprising:

the light bulb, which has a pair of conductive leads, each lead having an end;

a socket having an underside, a pair of sides, and a top side, said socket holding said light bulb so that a portion of said conductive leads is exposed on the underside of said socket, said socket further including a pair of bilateral channels on the sides of said socket, a receptacle which retains the ends of said leads, at least one lead retainer plug which is inserted into said receptacle to secure the ends of said leads within said receptacle, and a depression formed on the underside, of said socket so that said conductive leads extend across said depression;

a carriage, including two walls separated by a perpendicular cross-piece, said cross-piece forming an upper and lower slot in said carriage and having an aperture therethrough, said walls having a pair of bilateral guiding rails in said upper slot, said guiding rails formed to engage with said channels on said socket;

a pair of conductive wires having an insulated coating thereabout;

a base within said lower slot, said base having an upper crossbeam, a lower crossbeam and a center wall so that a pair of lateral slots is formed on each side of said center wall for the insertion of said conducting wires, and said upper crossbeam having two grooves therein;

a pair of conducting terminals separated by said center wall, each of said conducting terminals including a penetrating portion which penetrates the coating of said conductive wire so that said conductive terminal is in electrical contact with said conductive wire, an arcuate portion protruding through said aperture in said perpendicular crosspiece and engaged in said depression so that it is in electrical contact with one of said conductive leads, and exerts a force against said depression to maintain said socket on said carriage, and an end portion which rests freely in one of said pair of grooves so that said conducting terminal is allowed to bend freely when said socket slides onto said carriage; and a plug to hold said terminals in said base.

2. A low-voltage light fixture configured to facilitate insertion and removal of light bulbs and to provide a secure connection of the light bulb within said fixture, said fixture comprising:

the light bulb, which has a pair of conductive leads;

a socket to hold said light bulb in position so that a portion of said conductive leads is exposed, said socket including a plurality of channels on its exterior;

a carriage including two walls separated by a perpendicular crosspiece, said crosspiece forming an upper slot and a lower slot in said carriage and having an aperture for said exposed leads, said walls having a plurality of guiding rails in said upper slot, to engage with said channels;

conducting wires;

a base within said lower slot, said base having lateral slots for the insertion of said conducting wires; and conducting terminals, each of said conducting terminals including a contacting portion which is in electrical contact with said conducting wires, and an arcuate portion which is in electrical contact with each of said exposed leads.

3. The apparatus of claim 2 wherein said conducting terminals further include an end which rests freely to allow said terminals to flex freely.

4. The apparatus of claim 2 wherein a depression is formed on said socket so that said leads extend over said depression and said arcuate portion of said conducting terminals is proximate to said depression on said socket.

5. The apparatus of claim 4 wherein said arcuate portion of said terminals exerts a force against said leads so that tension is produced in said leads.

6. The apparatus of claim 2 wherein said socket includes a plurality of receptacles which retain said leads, said socket further including a plurality of lead retainer plugs which rest into said receptacle to secure said leads within said receptacle.

7. The apparatus of claim 2 wherein each of said contacting portions of said conducting terminals is pointed so that they penetrate into said conducting wires.

8. The apparatus claim 2 wherein said base includes a gap, and a plug which fits into said gap to hold said conducting terminals in said base.

9. A low-voltage light fixture for use with a decorative lighting system, said fixture configured to facilitate the insertion and removal of light bulbs, and to reduce the likelihood of accidental electrical short circuit, said light fixture comprising:

the light bulb, which has a pair of conductive leads, each lead having an end;

conducting wires;

a socket having an underside, sides, and a topside, said socket holding said light bulb so that a portion of said conductive leads is exposed near said underside, said socket including a plurality of receptacle chambers which retain the ends of said leads, said socket further including lead retainer plugs which are inserted into said receptacle so that the ends of said leads are fastened within said receptacles;

a carriage to hold said socket;

a base within said carriage to separate said conducting wires; and a plurality of conducting terminals separated by said base, each of said conducting terminals including a contacting portion which is in electrical contact with said conducting wires, and an arcuate portion which is in electrical contact with one of said conductive leads.

10. The apparatus of claim 9 wherein said socket includes a pair of bilateral channels on the sides of said socket, and said carriage includes a pair of bilateral guiding rails to engage with said channels on said socket.

11. The apparatus of claim 9 wherein said conducting terminals include ends which rest freely within a groove formed in said base.

12. The apparatus of claim 9 wherein a depression is formed on the underside of said socket so that said leads extend over said depression and said arcuate portion of said conducting terminals is proximate to said depression to hold said socket in said carriage.

13. The apparatus of claim 9 wherein each of said contacting portions of said conducting terminals is pointed so that they penetrate into said conducting wires.

14. The apparatus of claim 9 wherein said base includes a gap, and a plug which fits into said gap to hold said conducting terminals in said base.

15. A low-voltage light fixture for use with a decorative lighting system, said fixture configured to facilitate the insertion and removal of light bulbs, said fixture further configured to improve the conductive contact with said bulb in said fixture despite repeated replacement of said bulbs, said fixture comprising:

the light bulb, which has a pair of conductive leads;

a socket having an underside, a pair of sides, and a topside, said socket holding said light bulb so that a portion of said conductive leads is exposed on the underside of said socket, said socket including a depression formed on the underside of said socket so that said conducting leads extend over said depression;

a carriage including two walls separated by a cross-piece, said cross-piece forming an upper slot and a lower slot in said carriage and having an aperture therethrough;

a pair of conducting wires;

a base within said lower slot, said base having a pair of lateral slots for the insertion of said conducting wires; and a pair of conducting terminals, each of said conducting terminals including a contacting portion which is in electrical contact with said conducting wires, an arcuate portion which protrudes through said aperture in said cross-piece and is in electrical contact with one of said conductive leads, said arcuate portion being proximate to said depression on the underside of said socket, said arcuate portion exerting a force against said depression to hold said socket on said carriage and contact said leads in said depression.

16. The apparatus of claim 15 wherein said depression on the surface of said carriage is triangular in shape.

17. The apparatus of claim 15 wherein each of said conducting terminals has an end which rests freely within a groove formed in said base.

18. The apparatus of claim 15 wherein each of said contacting portions of said conducting terminals is pointed so that they penetrate into said conducting wires.

19. The apparatus of claim 15 wherein said base includes a gap, and a plug which fits into said gap to hold said conducting terminals in said base.

20. A low-voltage light fixture for use with a decorative lighting system, said fixture configured so as to facilitate the insertion and removal of light bulbs, said fixture further configured to reduce deformation of conductive terminals within said fixture, said fixture comprising:

the light bulb, which has a pair of conductive leads;

a socket having an underside, a pair of sides, and a topside, said socket holding said light bulb so that a portion of said conductive leads is exposed;

conducting wires;

a base having a pair of lateral slots for the insertion of said conducting wires, and a pair of grooves; and a pair of conducting terminals, each of said conducting terminals including a contacting portion which is in electrical contact with said conducting wires, an arcuate portion which is in electrical contact with one of said conductive leads, and an end portion which rests freely in one of said pair of grooves so that said each of said conducting terminals is allowed to bend freely.

21. The apparatus of claim 20 wherein said pair of grooves in said upper crossbeam are sawtoothed shaped.

22. The apparatus of claim 20 wherein a depression is formed on the underside of said socket so that said leads extend over said depression and said arcuate portion of said conducting terminals is proximate to said depression on the underside of said socket, said depression exerting a force against said arcuate portion so that said arcuate portion exerts a reactive force against said conductive leads.

23. The apparatus of claim 10 wherein each of said contacting portions of said conducting terminals is pointed so that they penetrate into said conducting wires.

24. The apparatus of claim 20 wherein said base includes a gap, and a plug which fits into said gap to hold said conducting terminals in said base.

* * * * *